United States Patent [19]

Kelly

[11] Patent Number: 4,605,166

[45] Date of Patent: Aug. 12, 1986

[54] ACCUMULATOR INJECTOR

[75] Inventor: William W. Kelly, Granby, Conn.

[73] Assignee: Stanadyne, Inc., Windsor, Conn.

[21] Appl. No.: 704,033

[22] Filed: Feb. 21, 1985

[51] Int. Cl.[4] ..... F02M 41/16; F02M 47/02; B05B 1/30; F02D 39/10

[52] U.S. Cl. ..... 239/96; 123/446; 239/88; 239/585

[58] Field of Search ..... 239/88, 89, 90, 91, 239/95, 96, 585; 123/299, 300, 446

[56] References Cited

U.S. PATENT DOCUMENTS 4,129,255 12/1978 Bader, Jr. et al. ..... 239/585 X
4,211,202 7/1980 Hafner ..... 239/585 X

FOREIGN PATENT DOCUMENTS 1284687 10/1967 Fed. Rep. of Germany ..... 123/300

*Primary Examiner*—Joseph F. Peters, Jr.
*Assistant Examiner*—Patrick N. Burkhart
*Attorney, Agent, or Firm*—Prutzman, Kalb Chilton & Alix

[57] ABSTRACT

An accumulator injector employs a shuttle piston assembly to produce a pilot injection prior to the primary fuel injection of the injector and to control the injection rate. The shuttle piston communicates with the control chamber and the accumulator chamber of the injector to provide a controllable pressure bleed means for controlling the valve needle lift of the injector.

12 Claims, 8 Drawing Figures

ACCUMULATOR INJECTOR

BACKGROUND AND BRIEF SUMMARY OF THE INVENTION

The present invention relates generally to accumulator fuel injection systems and relates more particularly to a new and improved accumulator injector which provides improved control of the fuel injection rate.

Accumulator-type nozzles or injectors generally function in a manner wherein pressurized fuel supplied from a pump accumulates within a chamber of the injector. A needle valve is responsive to opposing fuel pressure exerted forces and upon release of pressure is lifted to inject fuel into an engine cylinder. A characteristic of accumulator-type injectors is a so-called negative rate of injection wherein the rate of fuel injection at the commencement of the fuel injection is significantly greater than the rate of fuel injection at the termination of the injection. The negative rate of injection characteristics may result in excessive noise and an increase in exhaust pollutants from the internal combustion engine. It is a principal aim of the present invention to provide a new and improved accumulator injector which ameliorates the negative injection rate characteristics common to accumulator injectors and produces a pilot injection or two phase injection.

DESCRIPTION OF THE PREFERRED EMBODIMENT

Figure 1:
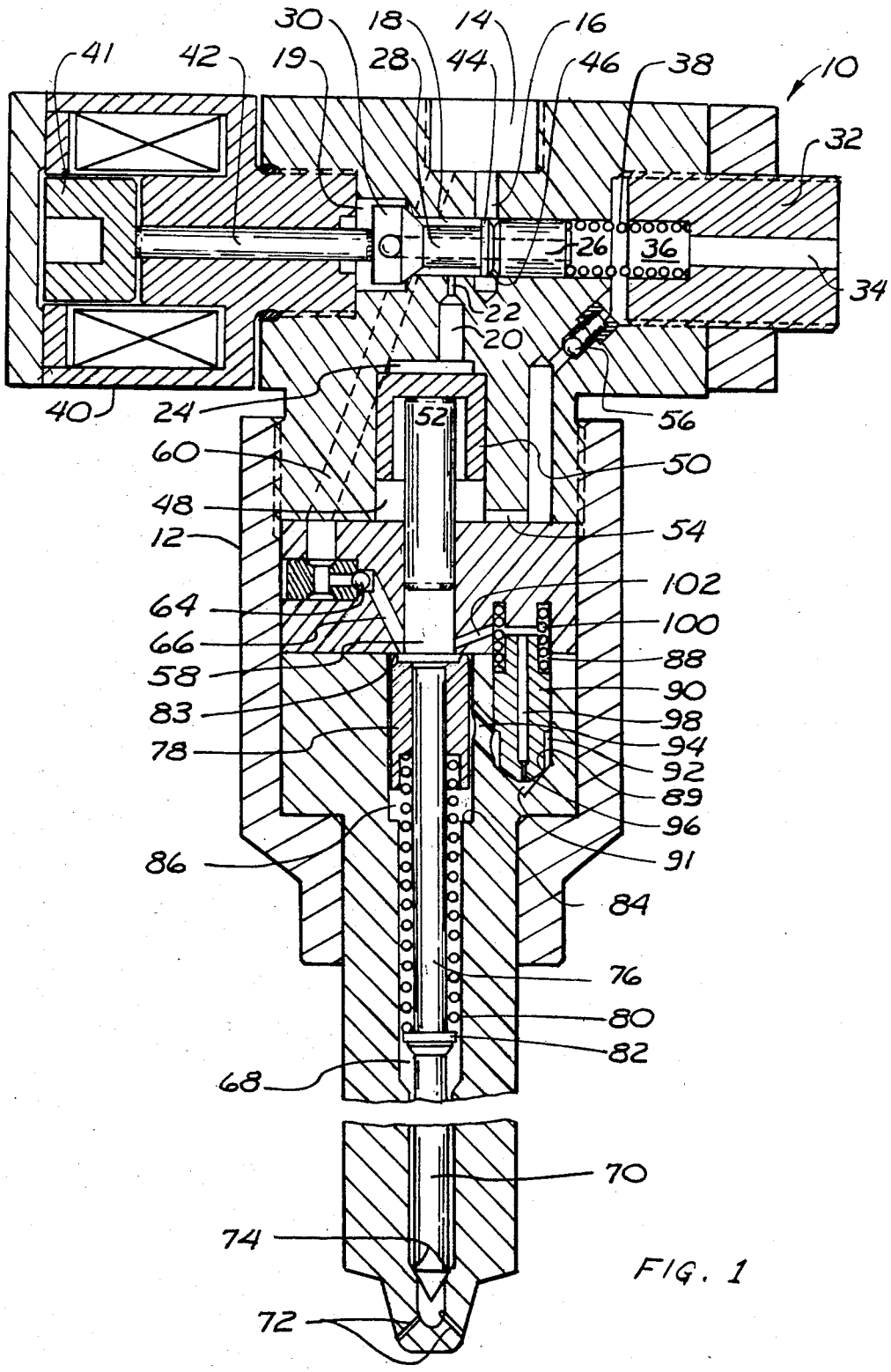
FIG. 1 is an axial sectional view, partly broken away and partly in section, of an accumulator injector in accordance with the present invention.

With reference to the drawings, an accumulator injector in accordance with the present invention is generally designated by the numeral 10. The accumulator injector 10 is designed to be used with an internal combustion engine of the compression/ignition type (not illustrated) for injecting a pressurized charge of fuel into an engine cylinder. Accumulator injector 10 is preferably employed in a fuel injection system (not illustrated) of a type which employs a fuel pump to receive fuel from the fuel tank and supply fuel under pressure to a fuel conduit or rail leading to identical accumulator injectors of the associated internal combustion engine. A regulator may be employed for automatically regulating the fuel pressure of the fuel supply pump in accordance with the engine speed and/or other parameters relating to the engine operation. Thus, a supply pump preferably delivers a continuous supply of fuel under a pressure which is regulated in accordance with the speed and/or load of the engine. Conduit means are also provided to return fuel from each injector to the fuel tank.

Accumulator injector 10 has a generally elongated injector body 12 which is generally adaptable for receiving pressurized fuel at an upper end thereof and controllably discharging discrete charges of pressurized fuel at a lower tip thereof. A fuel inlet bore 14 communicates with an axial valve inlet bore 16 which leads to a tranversely extending valve bore 18. One end of valve bore 18 forms discharge cavity 19 having an enlarged diameter. An axial valve outlet bore 20 connects an intensifier chamber 24 with the valve bore 18 via a restriction or orifice 22.

An intensifier control valve member 26 is mounted in valve bore 18 and is axially positioned (a) to selectively control the flow of pressurized fuel from the fuel inlet bore 14 to the intensifier chamber 24 and (b) to selectively control the discharge of fuel from the intensifier chamber 24. Intensifier control valve member 26 is an elongated spool-like member having a head 30 of enlarged diameter. Valve member 26 has a central axial bore 28 which radially communicates through its valve head 30 with the discharge cavity 19 of the valve bore 18. The head 30 of the control valve member 26 has a tapered annular shoulder engageable with a tapered valve seat to prevent the discharge of fuel from the intensifier chamber 24 to the enlarged discharge cavity 19 of the valve bore when the intensifier valve is positioned as shown in FIG. 1.

A connector 32 having a central axial return bore 34 and an inner coaxial counterbore 36 is threaded to the injector body. A compression spring 38 is received in the counterbore 36 and engages the control valve member 26 to urge the control valve toward the enlarged discharge cavity 19 of the valve bore (to the left as viewed in FIG. 1). Return bore 34 communicates with a return conduit (not illustrated) of the fuel injection system for returning fuel to the fuel tank.

A solenoid 40 includes an armature 41 which drives a linear actuating pin 42. The axial position of the control valve member 26 is governed by the position of actuating pin 42. When the solenoid is energized, the armature acting through the actuating pin seats control valve member 26 in the position shown in FIG. 1 so that fuel is supplied from the inlet bore 14 to the intensifier chamber 24 via an annulus formed between an intermediate land 44 of the control valve member and its enlarged valve head 30. When the solenoid is deenergized, the actuating pin is retracted and the spring 38 shifts the control valve member to the left as viewed in FIG. 1 toward the enlarged spill cavity portion 19 of the control bore so that the land 44 prevents the passage of pressurized fuel from the fuel inlet 14 bore to the intensifier chamber 24. At the same time, the valve member 26 is unseated to discharge fuel from the intensifier chamber to the enlarged discharge bore 19. An intermediate annular recess 46 adjacent the sealing land 44 is provided for balancing the hydraulic forces on the control valve member 26.

An enlarged axial bore 48 slidably receives an upper relatively large piston 50 of a two part intensifier having a lower, relatively small, piston 52. The lower end of the axial bore 48 communicates with a return passage 54 having a spring seated, low pressure, one-way check valve 56 to control leakage back to bore 48 thus ensuring low pressure in bore 48.

The relatively small intensifier piston 52 moves in intermediate axial bore 58. A diagonal inlet passage 60 (illustrated in broken lines) leads from the injector inlet bore 14 to supply fuel at a fuel inlet or rail pressure to the lower end of the bore 58 which forms a nozzle control chamber at the upper end of the fuel injection nozzle. The inlet fuel path communicates with the control chamber via an inlet check valve 64 and an inner diagonal passage 66.

An elongated stepped axial bore 68 having an enlarged upper end axially terminating at a circumferentially extending shoulder 84 extends from the bottom of axial bore 58 to the tip of the injector. Axial bore 68 receives an elongated valve needle 70 which is axially positioned to control the passage of pressurized fuel through one or more injection orifices 72 at the tip of the injector. The injector orifices 72 open from the lower end of the axial bore 68 into the engine cylinder (not illustrated). A tapered valve seat 74 is formed in the interior of the injector body tip so that the lower terminus of the valve needle 70 engages the seat to close the injector orifices 72 to the passage of pressurized fuel from the axial bore 68.

The valve needle includes an upper stem 76 which supports an axially displaceable inlet check valve or collar 78. A compression spring 80 having a relatively weak preload on the order of 5–10 lbs. encircles stem 76 and axially acts between the lower end of check valve 78 and an intermediate flange 82 of the valve needle to seat the check valve 78 against the shoulder 83 and to seat the needle against seat 74, thus closing the injection orifices 72. Check valve 78 is axially displaceable downwardly from its valve seat 83. Check valve 78 has peripheral axial slots to conduct fuel from the upper control chamber 58 to the bore 68 when the check valve is displaced downwardly from its valve seat 83. The axial bore 68 forms an accumulator chamber 86 which receives fuel via the check valve 78 from the control chamber 58.

A shuttle bore 88 parallel and closely adjacent to axial bore 68 receives an elongated shuttle piston 90 axially shiftable in the shuttle bore 88. The lower end of the shuttle piston has a reduced diameter, forming an annulus 92 which communicates via shuttle passage 94 with the accumulator chamber 86. The lower terminus of the shuttle piston has a conical or tapered shape. The lower end of the shuttle piston bore forms a conical or tapered seat 89 for receiving the tapered end of the shuttle piston to form a reduced diameter trigger chamber 91 below the reduced diameter end of the shuttle piston. An axial pressure bleed passage 98 in the shuttle piston having an orifice 96 provides fluid communication between the upper and lower ends of the shuttle bore 88. A compression spring 100 is mounted within upper annuli surrounding the upper end of the shuttle piston and an end stop formed in the injector body to bias the shuttle piston downwardly to engage its lower conical seat 89. The upper end of the shuttle bore communicates with control chamber 58 via shuttle passage 102.

In operation, the accumulator chamber 58 is initially charged at rail pressure via the inlet passage 60 and inlet check valve 64. The solenoid remains deenergized during this initial charging phase and the intensifier remains fully retracted as shown in FIG. 1. The solenoid 40 is then energized to operate the intensifier and thereby intensify the pressure in chamber 58 which then pressurizes accumulator chamber 86 through check valve 78. The intensifying position of the control valve is illustrated in FIG. 1. Fuel under pressure is thereby supplied via the control valve to the intensifier chamber 24. The intensifier piston 52 is thereby driven downwardly to intensify the fuel pressure in the control chamber 58 and in the accumulator chamber 86. The control chamber communicates through passage 102 with the upper end of the shuttle bore 88 and via the axial passage 98 in the shuttle with the lower end of the shuttle bore. The accumulator chamber 86 communicates via passage 94 with the annulus 92 so that the opposing axial forces on the shuttle are balanced and the compression spring forces the shuttle piston to the seated position illustrated in FIG. 1. A small quantity of pressurized fuel also flows through axial bore 98 and bleed orifice 96 to trigger chamber 91. During charging the pressure in the control chamber 58 is slightly greater than the pressure in the accumulator chamber 86 due to the pressure drop through the check valve 78. The valve needle is held in its seated position closing the orifices 72 to the passage of pressurized fuel from the accumulator chamber. At the end of the compression stroke of the intensifier piston, the accumulator chamber 86 has been fully pressurized, the hydraulic pressure exerted against the opposite ends of the shuttle piston 90 are substantially equal and check valve 78 is seated against the shoulder 83.

In a preferred embodiment as depicted, the inlet supply pressure or rail pressure varies from 4000–8000 psi and the intensifier piston is dimensioned to intensify the pressure in the control chamber 58 on the order of twice that of the supply pressure. The accumulator chamber is dimensioned to provide a 40 $mm^3$ mean injection delivery at a rail pressure of 8,000 psi.

When the solenoid 40 is de-energized, the actuating pin 42 retracts and the control valve member 26 is displaced by its return spring (to the left in FIG. 1) to release the pressure in the intensifier chamber 24. The pressure release or spill path leads from the intensifier chamber 24 via supply passage 20, supply orifice 22 and enlarged cavity 19 through the axial bore 28 of the control valve member 26 to the return bore 34. The pressure in the control chamber 58 rapidly decreases to a pressure significantly less than the pressure in accumulator chamber 86 to permit the valve needle 70 to be lifted from its seat by the hydraulic pressure in the accumulator to inject pressurized fuel through the nozzle orifices 72 into the engine cylinder. The fuel injection results in a corresponding reduction in the pressure in the accumulator chamber 86 in accordance with effective flow area through the nozzle orifices. In order to prevent an uncontrolled reseating of the valve needle, the rate at which the pressure in the control chamber 58 decreases due to the retraction of the intensifier piston exceeds the rate at which the pressure in the accumulator chamber 86 decreases as a result of the fuel injection. The solenoid 40 regulates the control valve member 26 to control the timing of the fuel injection.

The sharp decrease in the pressure in the control chamber 58 causes the shuttle piston to be lifted by pressure in the accumulator chamber 86 which is present in the annulus 92 surrounding the shuttle piston. The pressure of fuel in chamber 91 decreases at essentially the same rate as that of the control chamber so that the pressure force acting on the shuttle piston is that acting in the annulus 92. Since the pressure in chamber 58 decreases more rapidly than the pressure in chamber 86, the pressure forces on the shuttle piston exceed the force of spring 100, thus allowing the shuttle piston to unseat. As the shuttle piston lifts from the seat 89, the shuttle tip is exposed to the pressure from the accumulator chamber thus creating an additional force imbalance in the shuttle. The total force imbalance propels the shuttle piston until either a force balance condition is reestablished or until the shuttle piston hits a stop at the top of the shuttle bore. The shuttle piston is configured and dimensioned so that the time period of travel of the shuttle piston is roughly balanced with the rate of pressure release in the control chamber. The diameters of the bleed orifice 96 and supply orifice 22 are selected in order to assure that the proper pressure differential characteristics are obtained. The upward displacement of the shuttle piston rapidly reduces the effective volume of the control chamber and has the effect of increasing the pressure therein (disregarding the pressure release due to the retraction of the intensifier piston) while at the same time it rapidly increases the effective volume of the accumulator chamber 86 to decrease the pressure therein (in addition to the pressure decrease resulting from the fuel discharge through orifices 72). The shuttle piston remains unseated until the next charging event forces it to reseat when the downward force exerted by the pressure in the control chamber plus the force of spring 100 exceeds the upward force exerted by the pressure in the accumulator chamber.

A primary function of the shuttle piston is to ameliorate the negative rate of injection characteristics of accumulator injectors. The shuttle piston functions to provide a dual phase injection process or (under certain conditions) an injection process comprising an initial pilot injection and a succeeding primary injection thereby limiting the fuel quantity prepared for burning at the start of combustion. Generally, accumulator injectors have significantly greater fuel injection rates at the commencement of fuel injection than at the conclusion of the injection. The shuttle piston functions at the initiation of the fuel injection to limit the valve needle lift (and/or reseat the valve needle) and injection pressure by decreasing the accumulator chamber pressure by increasing the volume at the lower end of the shuttle bore and decreasing the rate of pressure decrease in the control chamber 58 by decreasing the volume at the upper end of the shuttle bore. The valve needle lift is also dependent on the pressurization of fuel in control chamber 58 which results from the displacement of the upper end of valve needle 76 into the control chamber during fuel injection.

Figure 2A:
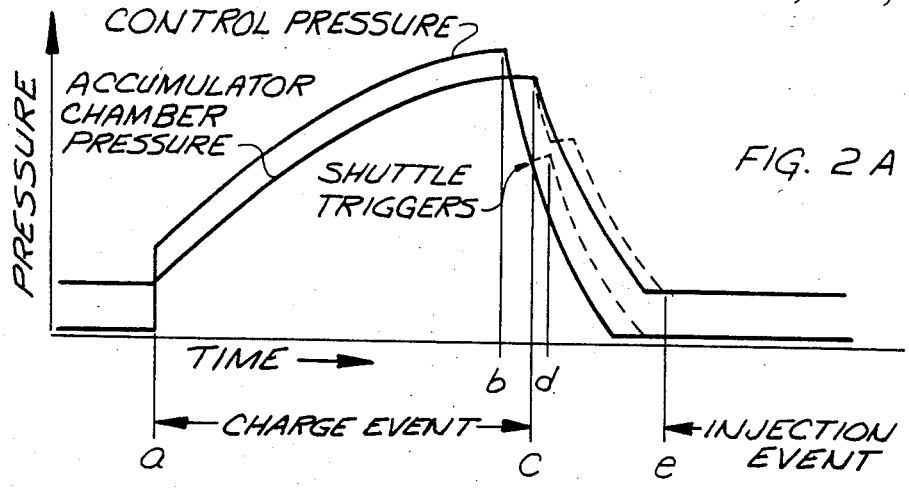
FIGS. 2A, 2B and 2C are graphical representations illustrating various characteristics of the injection event of an accumulator injector with and without a shuttle valve of the present invention.
Figure 2B:
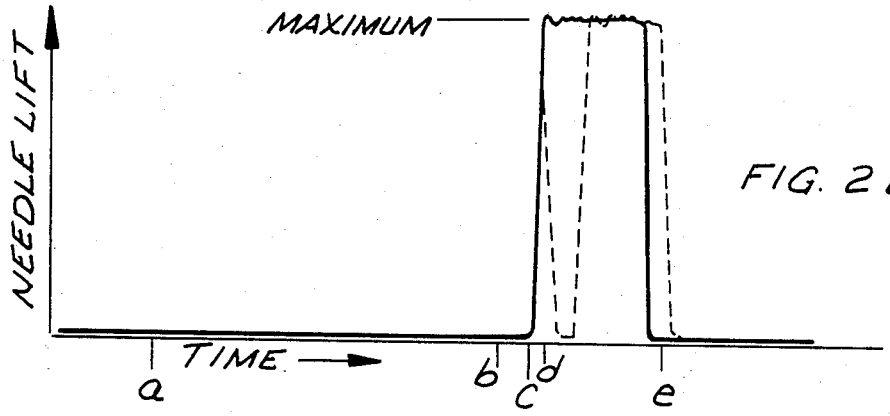
Figure 2C:
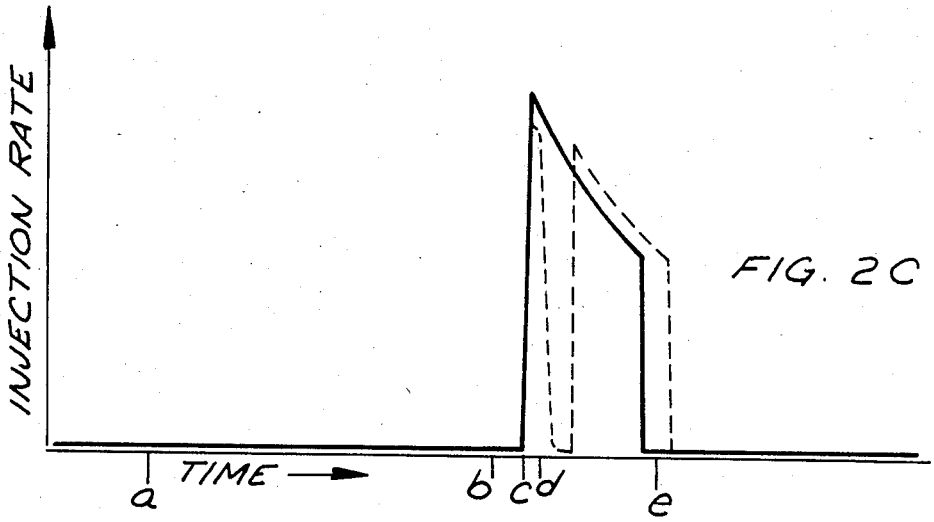

FIGS. 2A, 2B and 2C graphically illustrate various characteristics of an accumulator injector injection event. Characteristics of a conventional accumulator injector are indicated by solid lines and characteristics of an accumulator injector incorporating a pilot shuttle assembly in accordance with the present invention are indicated by broken lines. FIG. 2A shows the control chamber pressure and the accumulator chamber pressure during the charging and injection events. At time a the control pressure increases sufficiently to open check valve 78, after which both the accumulator chamber 86 and control chamber 58 pressures rise in unison. At time b the valve head 30 unseats immediately reducing the pressure in chamber 58. At time c the valve needle 70 starts to lift, as its upward force exceeds the holding force, and the injection event commences. Then at a time closely following time c the pressure differential across the shuttle piston 90 unseats the shuttle piston and propels it upward, increasing the pressure in control chamber 58. The decreasing pressure in accumulator chamber 86 eventually reduces the needle differential force to reseat the valve needle 70 temporarily terminating the injection. Shortly thereafter, at time d the pressure in control chamber 58 resumes its decrease to subsequently reopen the valve needle 70 to complete the injection. The injection terminates at time e.

FIGS. 2B and 2C illustrate the corresponding needle lift and injection rate characteristics for the injection event. It should be noted that the use of a high intensifier ratio (the ratio of the area of piston 50 to the area of piston 52) relative to the desired injection pressures results in a pilot shuttle behavior which is primarily dependent upon fuel quantity. In general, the pilot injection occurs at low fuel delivery and diminishes at high fuel delivery. However, the use of a low intensifier ratio provides the added benefit of pilot injection and rate-of-injection control.

Figure 3C:
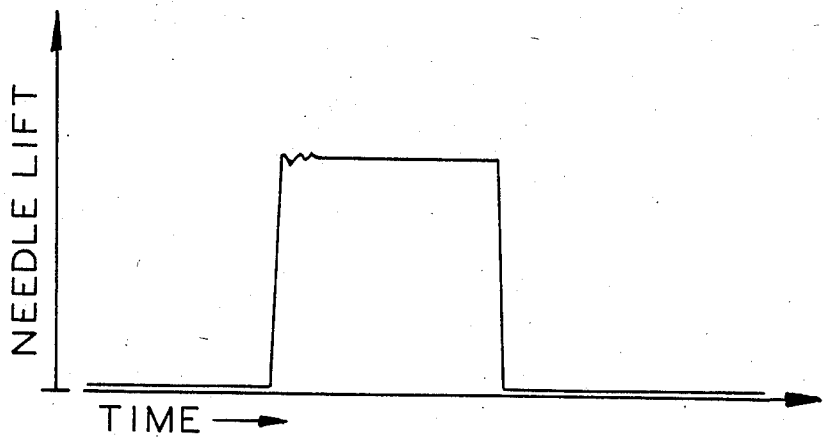
FIGS. 3A, 3B and 3C are graphical representations illustrating injection characteristics of the accumulator injector of FIG. 1 at various supply pressures.
Figure 3B:
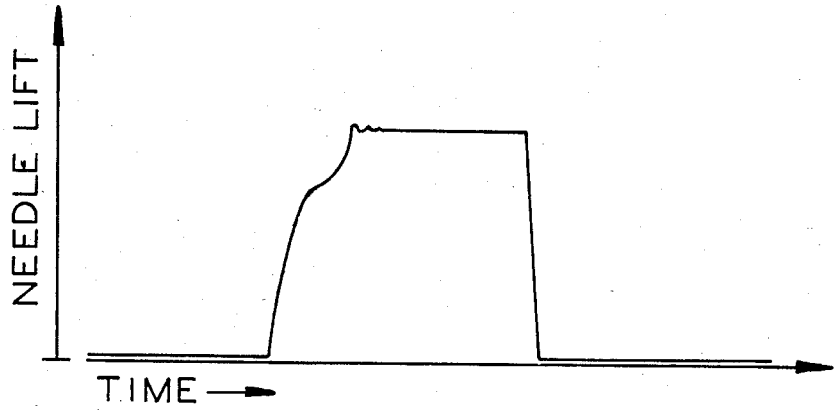
Figure 3A:
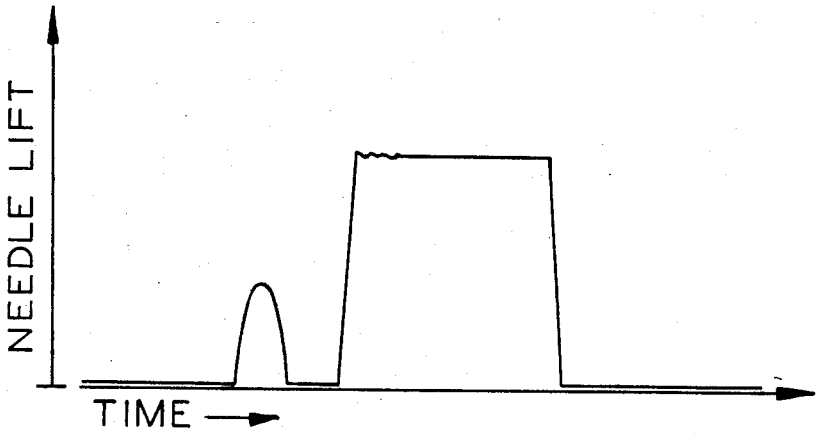

FIGS. 3A, 3B, and 3C graphically illustrate the valve needle lift or displacement for an accumulator injector 10 having a two to one intensifier ratio at 4,000 psi, 6,000 psi, and 8,000 psi supply or rail pressures, respectively. It will be appreciated that the shuttle piston assembly characteristics may be selected to provide a pilot injection prior to the primary injection of the pressurized fuel as graphically illustrated in FIG. 3A. The rapid decrease in the pressure in the control chamber initiated by de-energization of the solenoid will result in a consequent displacement of the shuttle piston resulting in an intermittent decrease in the rate of pressure decrease in the control chamber and pressure decrease in the accumulator chamber which are sufficient to partly or fully reseat the valve needle before the continuing higher rate of decrease in pressure in the control chamber results in the valve needle being subsequently relifted. The accumulator injector and in particular the shuttle piston assembly may be dimensioned to control both the fuel quantity in the pilot injection and the separation of the pilot injection from the primary fuel injection.

As engine speeds increase, higher injection pressures are required for optimal combustion. The pressure differential required to trigger the shuttle piston can be selected so that at low accumulator pressures such as 8000 psi a pilot injection is provided. At higher accumulator pressures such as 12,000 psi as graphically illustrated in FIG. 3B, the shuttle piston will trigger before nozzle opening conditions are reached so that a separate pilot injection does not occur, but more favorable injection rate characteristics are obtained, i.e., more nearly constant rate of injection throughout the entire injection period. At high accumulator pressures such as 16,000 psi as graphically illustrated in FIG. 3C, no or very limited injection rate shaping is produced by the shuttle piston. In general, as the supply pressure increases, the rate of pressure decrease in the control chamber 58 increases thereby making the valve needle position less sensitive to the shuttle piston.

At the end of injection the pressure in the control chamber and the bias force of spring 80 exceed the lower residual pressure in the accumulator chamber to rapidly reseat the valve needle. The valve needle reseats when the pressure in the accumulator chamber decreases to approximately rail or inlet pressure. When the solenoid 40 is energized, the control valve member is displaced to the charging position and the control chamber is rapidly pressurized by the intensifier. The bias force of spring 100 and the greater pressure in the control chamber function to rapidly reseat the shuttle piston. The pressure in the accumulator chamber then increases to condition the accumulator injector for the next fuel injection event. Generally, the bleed volume changes in the shuttle bore resulting from reseating the shuttle piston to condition the shuttle valve for the previously described fuel injection do not have a material effect on the reseating of the valve needle to close the injector.

It should be appreciated that the described and illustrated accumulator injector of FIG. 1 employs an intensifier accumulator system. The shuttle piston assembly may be employed in a similar manner in a non-intensified accumulator injector wherein the supply or rail pressure is employed to act directly at the control chamber rather than via an intensifier chamber and an intensifier piston.

Figure 4:
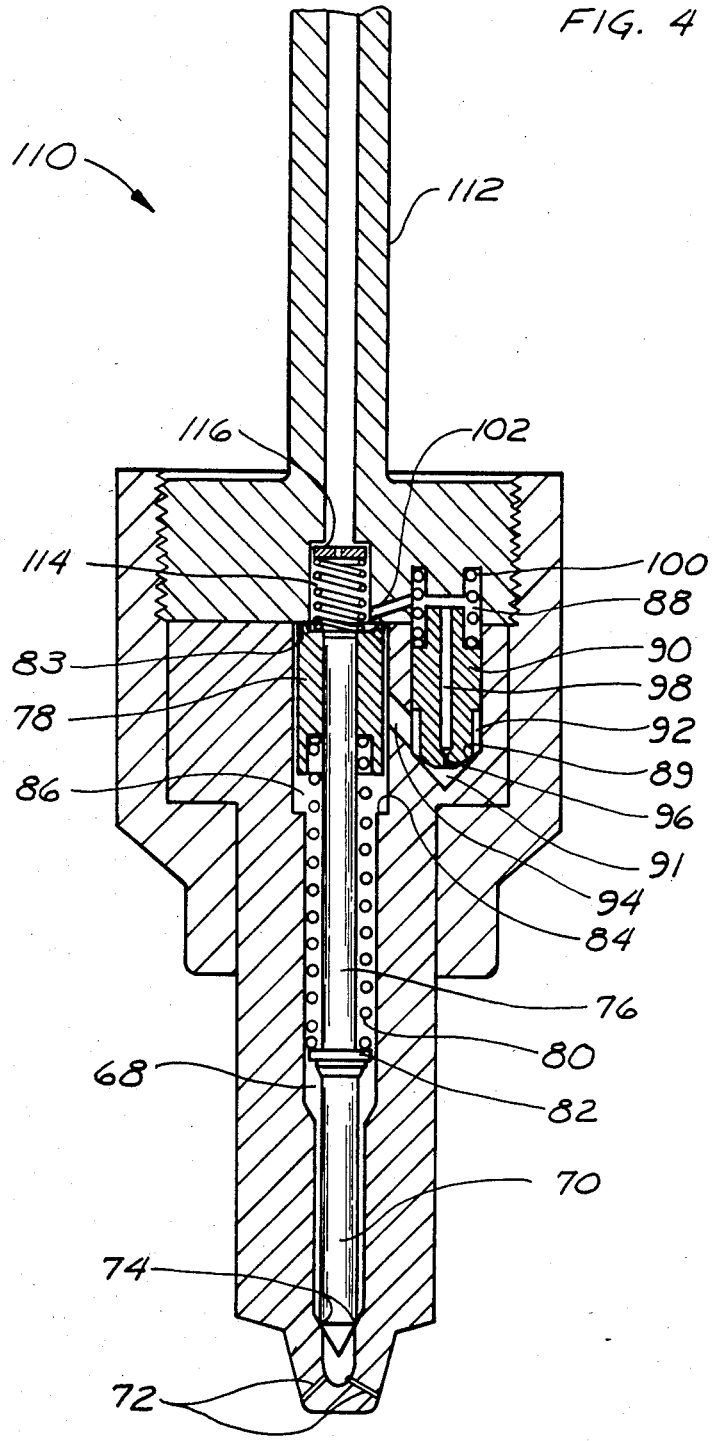
FIG. 4 is an axial sectional view, partly broken away and partly in section, of an alternate embodiment of an accumulator injector in accordance with the present invention.

With reference to FIG. 4, an alternative embodiment of an accumulator injector incorporating the present invention is generally designated by the numeral 110. Accumulator injector 110 is adapted for use in a pump-line-nozzle type fuel system which employs either a jerk or distributor pump to generate a high pressure wave or pulse. The high pressure wave passes through injection tubing 112 to the control chamber 114 of the injector. A spring biased bleed-check valve 116 may be interposed in control chamber 114 to control the release of pressure from the control chamber. The accumulator injector incorporates a pilot shuttle assembly as previously described. The pilot shuttle assembly of accumulator injector 110 essentially functions in substantially the same manner as described with respect to the embodiment of FIG. 1 except that the control chamber pressurization and the release of pressure in control chamber 114 is governed by the generation and delivery of high pressure waves by the distributor pump.

While a preferred embodiment of an accumulator injector in accordance with the present invention has been set forth purposes of illustration, the foregoing description should not be deemed a limitation of the invention herein. Accordingly, various modifications, adaptations, and alternatives may occur to one skilled in the art without departing from the spirit and scope of the present invention.

What is claimed is:

1. An accumulator injector for injecting a pressurized charge of fuel into a cylinder of an internal combustion engine comprising:

an injector body having a fuel inlet for receiving pressurized fuel at a supply pressure, an injection valve opening for discharging accumulated pressurized fuel and a valve seat surrounding the injection valve opening;

an elongated valve member mounted in the injector body and adapted for engagement with the valve seat to close the valve opening and for momentary axial displacement to open the valve opening;

an accumulator pressure chamber communicating with said fuel inlet and with said valve opening for discharging a pressurized charge of fuel upon opening said valve opening, said valve member being urged to open the valve opening by means of a supply pressure responsive pressure exerted in said accumulator chamber;

a control pressure chamber communicating with said fuel inlet, said valve member being urged to close the valve opening by means of a supply pressure responsive Pressure exerted in said control chamber;

pressure release means controllably actuable to effect a decrease in pressure in said control chamber;

a shuttle bore disposed in said injector body and receiving a shuttle piston which is axially displaceable to increase the pressure in one of said pressure chambers while decreasing the pressure in the other said pressure chamber so that actuation of said pressure release means displaces said valve member and said shuttle piston is actuated in response to the pressure differential between said pressure chambers to produce a two phase injection of pressurized fuel through said valve opening.

2. The accumulator injector of claim 1 wherein said shuttle bore forms a seat and the shuttle piston has a tapered end portion which is seatable against said seat to form a trigger pressure chamber, said shuttle piston being biased by a spring to seat against said bore seat.

3. The accumulator injector of claim 2 wherein said shuttle piston has an axial bleed bore and a restricted bleed orifice communicating with said trigger chamber, said orifice being dimensioned to permit displacement of the shuttle piston from the seat in the event of a rapid pressure decrease in the control chamber.

4. The accumulator injector of claim 1 wherein said two phase injection includes a momentary reseating of the valve member to produce a pilot injection prior to a primary injection of pressurized fuel through the valve opening.

5. The accumulator injector of claim 4 wherein at relatively low supply pressures a pilot injection and a primary injection are produced while at relatively higher supply pressures only a primary injection is produced.

6. The accumulator injector of claim 1 wherein said pressure release means comprises a solenoid actuated control valve assembly for controllably effecting a rapid decrease in fuel pressure in said control chamber.

7. The accumulator injector of claim 3 further comprising an intensifier chamber and a supply passage, said intensifier chamber communicating via said supply passage with the fuel inlet, and an intensifier piston received in said intensifier chamber and wherein pressure in said control chamber is intensified by said intensifier piston driven by a supply pressure responsive pressure in said intensifier chamber.

8. The accumulator injector of claim 7 wherein said supply passage has a restricted control orifice, the control orifice and shuttle piston bleed orifice being dimensioned to provide a momentary reseating of the valve member in the event of a rapid pressure decrease in the control chamber.

9. The accumulator injector of claim 7 wherein the injector is chargeable so that the ratio of the pressure in the control chamber to the fuel inlet pressure is on the order of 2 to 1.

10. An accumulator injector for injecting a pressurized charge of fuel into a cylinder of an internal combustion engine comprising:

an injector body having a fuel inlet for receiving pressurized fuel at a supply pressure, an accumulator pressure chamber communicating with said fuel inlet for accumulating pressurized fuel, and a valve opening for discharging accumulated pressurized fuel;

a control chamber communicating with said fuel inlet and adapted for rapid charging with pressurized fuel;

pressure release means controllably actuable to effect a rapid decrease in pressure in said control chamber;

a valve member axially displaceable in response to opposing pressures in said accumulator and control pressure chambers to open and close said valve opening;

a shuttle bore forming opposing bleed chambers communicating with said control and accumulator pressure chambers;

a shuttle piston means received in said shuttle bore and displaceable in response to the pressure differential between said control chamber and said accumulator chamber to inversely variably change the volume of said opposing bleed chambers so that actuation of said pressure release means results in a two-phase displacement of said valve member.

11. The accumulator injector of claim 10 wherein said shuttle piston means comprises a spring biased piston having a tapered tip and an axial passage communicating with opposing variable bleed chambers.

12. The accumulator injector of claim 10 wherein actuation of the pressure release means triggers said shuttle piston to decrease the volume of the bleed chamber communicating with said control chamber so that said piston is displaced to momentarily open and close said valve opening prior to being redisplaced to open the valve opening.

* * * * *